US009369805B2

(12) United States Patent
Wilson

(10) Patent No.: US 9,369,805 B2
(45) Date of Patent: Jun. 14, 2016

(54) ACOUSTIC ABSORBER, ACOUSTIC TRANSDUCER, AND METHOD FOR PRODUCING AN ACOUSTIC ABSORBER OR AN ACOUSTIC TRANSDUCER

(75) Inventor: Willsingh Wilson, Berlin (DE)

(73) Assignee: WILSON, LEENA ROSE, Berlin (DE)

( * ) Notice: Subject to any disclaimer, the term of this patent is extended or adjusted under 35 U.S.C. 154(b) by 1138 days.

(21) Appl. No.: 13/148,272

(22) PCT Filed: Feb. 8, 2010

(86) PCT No.: PCT/EP2010/051520

§ 371 (c)(1),
(2), (4) Date: Nov. 21, 2011

(87) PCT Pub. No.: WO2010/089398

PCT Pub. Date: Aug. 12, 2010

(65) Prior Publication Data

US 2012/0155688 A1 Jun. 21, 2012

(30) Foreign Application Priority Data

Feb. 7, 2009 (DE) ..... 10 2009 007 891

(51) Int. Cl.

| | |
|---|---|
| ***E04B 1/84*** | (2006.01) |
| ***H04R 7/26*** | (2006.01) |
| ***G10K 11/168*** | (2006.01) |
| *E04B 1/74* | (2006.01) |

(52) U.S. Cl.

CPC ..... *H04R 7/26* (2013.01); *G10K 11/168* (2013.01)

(58) Field of Classification Search

USPC ..... 181/290, 294, 284, 291, 30, 207

See application file for complete search history.

(56) References Cited

U.S. PATENT DOCUMENTS

| | | | |
|---|---|---|---|
| 3,925,287 | A | 12/1975 | Anderson |
| 5,493,081 | A | 2/1996 | Manigold |
| 5,536,910 | A | 7/1996 | Harrold et al. |

(Continued)

FOREIGN PATENT DOCUMENTS

| | | | |
|---|---|---|---|
| AU | 2006201764 | A1 | 5/2006 |
| CN | 2770039 | | 4/2006 |

(Continued)

OTHER PUBLICATIONS

Yvonne Kavermann, Hubert Satzger: "Mineral wool boards as sound absorbers comprising a mounting space", May 12, 2008 XP002597589, Baunetz Wissen, Akustik.

(Continued)

*Primary Examiner* — Edgardo San Martin
(74) *Attorney, Agent, or Firm* — Maschoff Brennan

(57) ABSTRACT

The invention relates to an acoustic absorber comprising an absorption layer (1*a*, 1*b*) composed of an open-pored porous material. According to the invention, the open-pored porous material is flexurally stiff in such a way that the absorption layer (1*a*, 1*b*) is stimulated to flexurally oscillate when sound waves impinge on the absorption layer and the absorber can absorb sound waves of a first frequency range because of the inflow of air into the open-pored porous material of the absorption layer and can absorb sound waves of a second frequency range that comprises lower frequencies than the first frequency range because of the stimulation of flexural oscillations of the absorption layer. The invention further relates to an acoustic transducer and to a method for producing an acoustic absorber or an acoustic transducer.

13 Claims, 11 Drawing Sheets

(56) References Cited

U.S. PATENT DOCUMENTS

| | | | | |
|---|---|---|---|---|
| 5,665,943 | A * | 9/1997 | D'Antonio | 181/295 |
| 5,975,238 | A * | 11/1999 | Fuchs et al. | 181/295 |
| 6,145,617 | A | 11/2000 | Alts | |
| 6,376,396 | B1 | 4/2002 | Thorn et al. | |
| 6,454,048 | B1 * | 9/2002 | Alts et al. | 181/290 |
| 6,569,509 | B1 | 5/2003 | Alts | |
| 7,137,477 | B2 | 11/2006 | Keller et al. | |
| 7,440,580 | B2 * | 10/2008 | Grimani et al. | 381/353 |
| 7,757,809 | B2 * | 7/2010 | Pfaffelhuber et al. | 181/290 |
| 7,772,143 | B2 | 8/2010 | Hermann et al. | |
| 7,918,313 | B2 * | 4/2011 | Gross et al. | 181/294 |
| 7,947,364 | B2 * | 5/2011 | Ghosh | 428/304.4 |
| 7,968,180 | B2 * | 6/2011 | Sugawara et al. | 428/316.6 |
| 8,194,879 | B2 * | 6/2012 | Ishikawa et al. | 381/86 |
| 8,499,887 | B2 * | 8/2013 | Gleine et al. | 181/292 |
| 8,631,899 | B2 * | 1/2014 | Zickmantel | 181/286 |
| 8,637,414 | B2 * | 1/2014 | Gomez et al. | 442/409 |
| 2005/0241877 | A1 * | 11/2005 | Czerny et al. | 181/293 |
| 2006/0169531 | A1 * | 8/2006 | Volker | 181/204 |
| 2007/0137926 | A1 * | 6/2007 | Albin et al. | 181/290 |
| 2007/0202302 | A1 * | 8/2007 | Matsuura | B32B 3/085 428/174 |
| 2008/0135332 | A1 * | 6/2008 | Ueda et al. | 181/284 |
| 2009/0085378 | A1 * | 4/2009 | Borchardt | B60R 13/0815 296/191 |
| 2009/0120717 | A1 * | 5/2009 | Tanase | 181/284 |
| 2009/0189111 | A1 * | 7/2009 | Zamani | 252/62 |
| 2009/0223738 | A1 * | 9/2009 | Nakamura et al. | 181/175 |
| 2010/0044148 | A1 * | 2/2010 | Tanase | 181/198 |
| 2011/0284689 | A1 * | 11/2011 | Thomas et al. | 244/1 N |
| 2014/0070562 | A1 * | 3/2014 | Inagaki | B32B 5/022 296/180.1 |
| 2014/0196998 | A1 * | 7/2014 | Nauman et al. | 188/377 |
| 2014/0272349 | A1 * | 9/2014 | Di Sante | B32B 5/24 428/213 |
| 2014/0332313 | A1 * | 11/2014 | Bischoff et al. | 181/290 |

FOREIGN PATENT DOCUMENTS

| | | | |
|---|---|---|---|
| DE | 2 325 730 | A1 | 12/1973 |
| DE | 29 05 067 | A1 | 8/1980 |
| DE | 32 17 784 | A1 | 11/1983 |
| DE | 43 39 709 | A1 | 5/1995 |
| DE | 296 18 737 | U1 | 3/1998 |
| DE | 197 08 188 | A1 | 9/1998 |
| DE | 103 24 257 | B3 | 9/2004 |
| DE | 102006045069 | | 4/2008 |
| DE | 10 2009 039 185 | A1 | 3/2011 |
| EP | 2 214 160 | A2 | 8/2010 |
| GB | 2 121 911 | A | 1/1984 |
| JP | 04-348397 | | 3/1992 |
| JP | H04-348397 | A | 12/1992 |
| JP | 3020204 | U | 10/1995 |
| JP | H09-224972 | A | 9/1997 |
| JP | H11-065572 | A | 3/1999 |
| JP | 11-065572 | | 9/1999 |
| JP | 2006011412 | A * | 1/2006 |
| JP | 2006-052479 | A | 2/2006 |
| WO | 95/14803 | A1 | 6/1995 |
| WO | 98/18657 | | 5/1998 |
| WO | 99/35007 | A1 | 7/1999 |
| WO | 9935007 | A1 | 7/1999 |
| WO | 02/04730 | A1 | 1/2002 |
| WO | 2007073732 | A2 | 7/2007 |
| WO | 2009/124104 | A1 | 10/2009 |

OTHER PUBLICATIONS

CN Office Action dated Jun. 5, 2013 in application No. 201080013094.6.

Yvonne Kavermann, Hubert Satzger: "Mineralwolle als Schallabsorber mit Montageabstand" (Online), May 12, 2008 XP002597589, Baunetz Wissen, Akustik.

Cox et al., "Acoustic Absorbers and Diffusers. Theory, design and application, Second edition", London, New York, Taylor & Francis, 2009, pp. 191-193, 156-175, 368-371.

Firma Borgers AG,"Excerpt of the product description Propylat" accessed at http://www.borgers-group.com/index.php?id=35 &type=1&L=title=???, accessed on Mar. 17, 2015, p. 1 (English Translation).

Firma Borgers AG,"Excerpt of the product description Tryflex" accessed at http://www.borgers-group.com/index.php?id=34 &type=1&L=0, accessed on Mar. 17, 2015, p. 1(English Translation).

Ford et al., "Panel Sound Absorbers", J. Sound Vib., vol. 10, No. 3, 1969, pp. 411-423.

* cited by examiner

FIG 2A
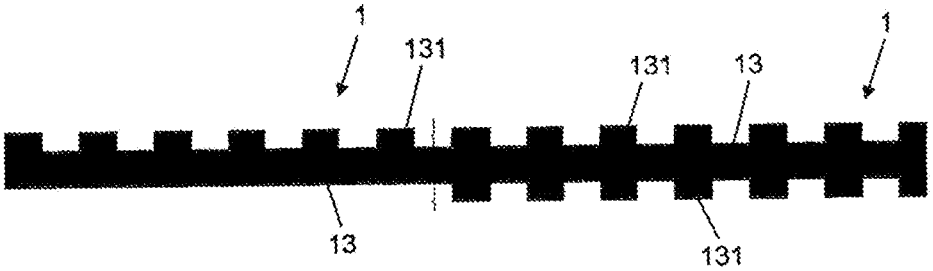
FIG 2B
FIG 2C
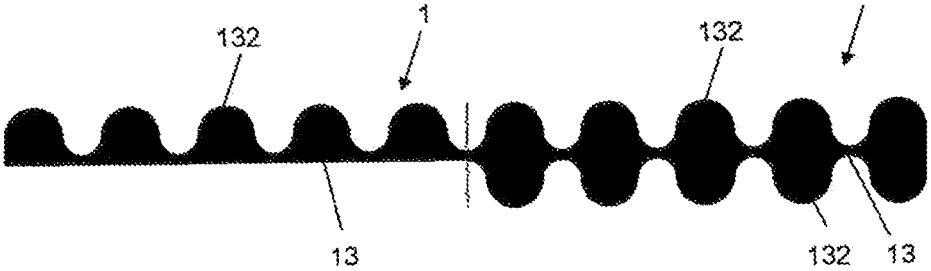
FIG 2D
FIG 3A
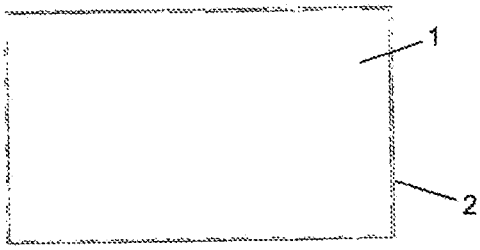
FIG 3B
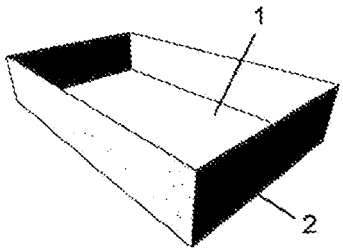

FIG 6A
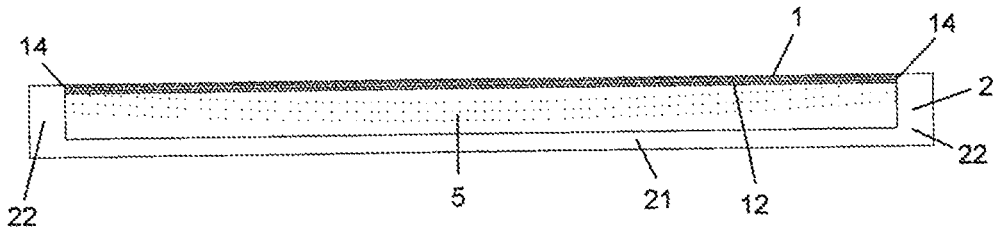
FIG 6B
FIG 6C
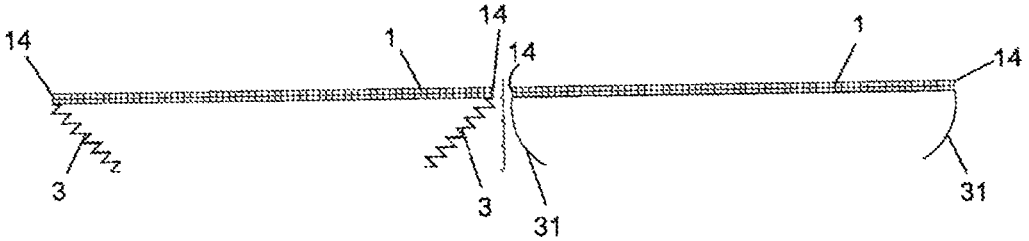

ACOUSTIC ABSORBER, ACOUSTIC TRANSDUCER, AND METHOD FOR PRODUCING AN ACOUSTIC ABSORBER OR AN ACOUSTIC TRANSDUCER

BACKGROUND

The invention relates to an acoustic absorber, an acoustic transducer, and a method for producing an acoustic absorber or an acoustic transducer.

It is known from the prior art to use open-pore porous materials for sound damping, with a "porous" material meaning a material having a specific proportion of cavity inclusions. An "open-pore" porous material is in particular a material in which the predominant proportion of the cavities in the material is in flow connection with other cavities. Owing to the interconnected cavities of the open-pore porous material, sound waves can thus enter the material and at least partially penetrate it.

The energy of the sound waves entering the open-pore porous material is at least partially converted into thermal energy in the material, in particular because the kinetic energy of air molecules that is associated with the sound wave is converted into heat on account of friction between the air molecules and the material surrounding the cavities. As a consequence of this absorption mechanism, sound waves of a shorter wavelength, i.e. a higher frequency, are absorbed more strongly than low frequencies.

Acoustic transducers, for example in the form of flat-panel loudspeakers, which however often have a strongly non-linear frequency characteristic, are furthermore known from the prior art.

SUMMARY

The problem underlying the invention is that of providing an acoustic absorber for absorbing sound waves, which can be produced in as simple a manner as possible while still allowing the absorption of sound over a relatively broad frequency range. The invention is furthermore based on the problem of specifying a method for producing such an acoustic absorber.

The invention in a further aspect is moreover based on the problem of providing an acoustic transducer that can be realized in a simple manner and enables as balanced a sound generation and/or sound absorption as possible.

According to the invention, an acoustic absorber for sound damping is provided, which acoustic absorber has an absorption layer formed from an open-pore porous material, with the open-pore porous material being flexurally stiff such that flexural vibrations are excited in the absorption layer when sound waves strike it and, owing to the inflow of air into the open-pore porous material of the absorption layer, the absorber can absorb sound waves in a first frequency range and, on account of the excitation of flexural vibrations of the absorption layer, sound waves in a second frequency range, which comprises lower frequencies than the first frequency range.

It is of course also possible for the first and second frequency ranges to partially overlap. In particular, the properties of the absorption layer can be chosen such that the two frequency ranges overlap in a predetermined overlapping frequency range in order to bring about increased absorption in this range.

The absorption layer thus combines two absorption mechanisms with each other, specifically the typical absorption of an open-pore porous material at higher frequencies with the absorption via the excitation of flexural vibrations at lower frequencies. This means in particular that the sound absorption in the lower frequency range, which is based on the excitation of flexural vibrations of the absorption layer, is greater than any low absorption which may still exist in this frequency range from the flow through the open-pore porous material. As a result, the absorber is able, even with only one absorption layer, to dampen sound waves over a wide frequency range, i.e. it is not necessary to provide other means for damping the sound waves at lower frequencies in addition to the open-pore porous absorption layer. In the absorber according to the invention, two different absorption mechanisms are thus connected in parallel, as it were.

Porous materials are all porous and fibrous materials such as textiles, nonwovens, carpet, foam, mineral wool, cotton, special acoustic plaster, expanded glass granulate and so-called pervious materials which absorb sound energy by converting the vibrations of the air particles into thermal energy by way of friction.

Thin open-pore porous absorption layers such as textiles preferably absorb in the high-frequency range. In order to achieve a relatively broad-band and high absorption even with relatively small material thicknesses, for example a plurality of open-pore porous absorption layers with increasingly high flow resistance are arranged in succession. In this case, in particular the layer with the lowest flow resistance faces the sound source. This ensures in particular that the absorption layers remote from the sound source do not lose their efficiency because they are covered by the remaining absorption layers.

In particular, the ratio of flexural stiffness (or of the mass, thickness and/or the dimensions) to the flow resistance of the absorption layer can be chosen in dependence on the intended use of the acoustic absorber, for example in order to avoid thudding in smaller rooms or too strong an absorption of high frequencies relative to lower frequencies. In particular, the formation of a "flutter echo" can, for example when fitting rooms with the absorber, be counteracted by suitably matching the absorption properties of the absorber according to the invention in the lower frequency range.

Furthermore, because the acoustic absorber according to the invention absorbs both in lower and in higher frequency ranges, it can replace a combination of various absorber types, as a result of which for example costs, weight and installation time can be reduced. However, the acoustic absorber according to the invention can of course also be combined with conventional absorber types, for example the absorption layer of the acoustic absorber according to the invention can be used as a terminating surface (issuing surface) of a Helmholtz resonator instead of the attenuation substance that is conventionally used as the terminating surface.

In one exemplary embodiment of the invention, the absorption layer has a flexural stiffness $$B = \frac{E \cdot t^3}{12 \cdot (1 - \mu^2)}$$

in the range of 0.5 to 500 $Nm^2$, in particular between 200 and 400 $Nm^2$, for example between 10 and 100 $Nm^2$ or between 10 and 30 $Nm^2$, wherein used as a measure for the flexural stiffness of the absorption layer is in particular the product of the modulus of elasticity E of the material of the absorption layer and the second moment of area I thereof (with reference to a direction that is perpendicular to the main extension plane of the absorption layer) (t: thickness of the absorption layer, μ: Poisson's ratio).

In particular, the absorption layer has such a flexural stiffness that the natural frequency of the absorption layer with respect to flexural vibrations is less than 600 Hz, in particular less than 300 Hz or in particular than 200 Hz.

With respect to directions which run parallel to the main extension plane of the absorption layer, the absorption layer can have a similar flexural stiffness. This is not absolutely necessary, however; the flexural stiffnesses with respect to different load directions can of course also vary.

In order that greater flexural vibration amplitudes are possible without damage to the absorption layer, the absorption layer can have a flexural elasticity, ductility and/or ultimate strength which is higher in particular than in the case of conventional absorbers (which have, for example, a mineral-fiber insulator or an open-cell porous foam). By way of example, the open-pore porous material of the absorption layer is more ductile than glass or stone wool, that is to say in particular that the open-pore porous material of the absorption layer has a greater ultimate strength than those materials. In one example, the permissible ultimate tensile strength of the open-pore porous material of the absorption layer is at least 10 percent higher than that of glass.

Moreover, the absorption layer can have a mass per unit area in the range of 30 g/m$^2$ to 20 kg/m$^2$, in particular between 1 to 5 kg or between 1 to 3 kg. However, the mass per unit area does not have to be constant across the absorption layer, but it can also be location-dependent, i.e. the mass per unit area can vary for example in the thickness direction of the absorption layer and/or in a direction perpendicular to the thickness direction. Moreover, the mass density of the open-pore porous material of the absorption layer can be generally location-dependent, i.e. vary across the absorption layer rather than just in the thickness direction.

By way of example, the mass density of the open-pore porous material increases in the thickness direction of the absorption layer (progressive densification) or it increases or decreases from the center of the absorption layer in the direction of its surfaces (which run perpendicular to the thickness direction). The mass density of the absorption layer can also increase with respect to a first cross-sectional area of the absorption layer in the thickness direction and decrease with respect to a second cross-sectional area which is at a distance from the first cross-sectional area. This can also be done in alternating fashion, i.e. viewed along the length or the width of the absorption layer, the mass density of the absorption layer alternately increases and decreases in the thickness direction. Moreover, the mass density can also have the form of a honeycomb structure for increasing the stability of the absorption layer.

"Absorption layer" of the absorber in particular refers to a sheet-like structure which extends along a main extension plane and its dimension that extends perpendicular to the main extension plane is small as compared to the dimensions that run parallel to the main extension plane. By way of example, the absorption layer is in the form of a plate, with the acoustic absorber for example consisting of, at least substantially, only this plate. In particular, the absorption layer is for example at least approximately rectangular, for example with a length of between 30 and 150 cm and a width of between 30 and 100 cm (with a thickness of between 5 and 20 mm, for example). However, the invention is of course not restricted to any particular form of the absorption layer, but the form and the dimensions of the absorption layer can in principle be selected arbitrarily depending on the intended use of the acoustic absorber.

The absorption layer does not necessarily have to be planar but it can also be curved at least sectionally, such that it can be arranged for example with respect to a concave or convex surface. It is furthermore possible to set the natural frequencies of the absorption layer or to scatter or focus the incident sound waves by way of the strength of the curvature of the absorption layer.

The absorption layer has for example a thickness in the range of 0.1 mm to 100 mm, in particular in the range between 3 mm and 20 mm, it being understood that it is not absolutely necessary for the absorption layer to have a constant thickness. It is also conceivable that the thickness is location-dependent, i.e. it can vary in a direction parallel to a main extension plane, along which the absorption layer extends, in order for example to increase the sound absorption by way of increasing the surface area of the absorption layer and/or to produce a diffusely sound-reflective surface (for example by way of a wave-shaped configuration of at least one surface of the absorption layer).

It is also possible that the absorption layer is level (i.e. at least substantially not curved), but is not continuous and has rather an opening for example (in particular a rectangular or circular opening). By way of example, the absorption layer can be configured such that it extends circumferentially around a (central) opening in the manner of a frame.

In this context, it should be understood that the absorption layer can also be configured like a component of an in principle arbitrary construction, for example in the form of a part of an item of furniture or a sound-damping partition or protective wall (for example to replace a drywall panel). In particular, the absorption layer can, owing to its flexural strength, withstand even relatively high mechanical loads, i.e. it is distinguished for example by a high ball-impact protection, shock resistance, protection against breakage, dimensional stability, dimensional resistance, scratch resistance, abrasion resistance, tensile strength and/or elasticity as compared in particular to conventional sound absorbers.

In addition, the surface of the absorption layer can be produced such that it is air-tight and/or water-tight (or water-repellant), with the result that the absorber according to the invention can for example also be used in areas with increased hygiene requirements and/or increased humidity or wetness.

Other possible uses of the absorber according to the invention are for example:

- loudspeaker diaphragm and/or microphone diaphragm (see below);
- duct sound attenuator;
- sound lock;
- sound screen;
- sound chamber;
- sound-insulating partition;
- arrangement of the absorber under wallpaper (in particular an air-permeable glass-fiber or textile wallpaper);
- arrangement of the absorber under air-permeable plaster (pervious);
- arrangement of the absorber under a veneer (for example a microperforated veneer);
- projection surface and absorber surface, with simultaneous sound emission;
- microphone/loudspeaker partition;
- microphone/loudspeaker sail.

The absorption layer of the absorber according to the invention can additionally be used as floor covering or as a subconstruction of a floor, in particular in conjunction with elastically resilient and/or soft open-pore porous materials (e.g. via a punctiform, linear and/or sheet-like connection region). In this way, sound absorption can be combined with vibration insulation or footfall sound insulation.

In one embodiment of the invention, the absorption layer has a flow resistivity in the range of 50-5000 Pa*s/m or $N*s/m^2$. In particular, the flow resistance of the absorption layer is dependent on its thickness and on the porosity of the open-pore porous material, where the "porosity" refers to the ratio of the cavity volume to the overall volume (cavity volume+solid-material volume) of the material.

By way of example, the porosity σ is defined as:

$$\sigma = 1 - \frac{\rho_{Absorber}}{\rho_{Material}},$$

ρ=mass density.

According to another development of the invention, the absorption layer is supported such that piston-type vibrations can be excited therein, i.e. owing to the action of sound, the absorption layer cannot only be excited to perform flexural vibration, but also a piston-type, i.e. at least approximately linear, vibration. As a result it is possible to widen the absorption spectrum of the acoustic absorber or to tune it with even more precision to a specified frequency (or a number of frequencies) or a frequency range. By way of example, the absorption layer can be supported on an air cushion, wherein the mass of the absorption layer as a vibration mass and the air cushion as a "spring" form a system that is capable of vibrating. In the region of the air cushion, absorber materials may additionally be arranged, see below.

By way of example, the natural frequency of the absorption layer with respect to the piston-type vibrations is in the range between 10 Hz and 2000 Hz. The natural frequencies of the absorption layer are, by comparison, for example between 0.00005 Hz and 200 Hz.

The absorption layer (which is configured, for example, in the form of a plate) can be inserted loosely for example in a frame, such that the frame effects for example a lateral guidance of the absorption layer, but the absorption layer is moveable to and fro in one direction perpendicular to the main extension plane thereof. In another variant, no frame is used; instead the absorption layer is supported in another manner such that it can perform free flexural movements, for example the absorption layer is suspended in the manner of lamellae. Another possibility is a floating supporting of the absorption layer on a (for example elastic) support. Other types of support of the absorption layer are of course possible, for example at least partially clamping the absorption layer or only partially placing or only partially allowing the absorption layer to vibrate freely or a combination of different types of support.

According to another variant of the invention, the acoustic absorber has a mass element connected to the absorption layer, for changing the natural frequencies of the absorption layer, with the mass element being able to influence the natural frequencies with respect to the flexural vibrations of the absorption layer and/or with respect to piston-type vibrations of the absorption layer. By way of example, the mass element is configured in the form of one or more material regions and has in particular likewise a porous material. However, in principle it is also conceivable that the mass element is formed from a non-porous material. In addition to a punctiform configuration of the mass element, in principle any desired geometries are conceivable, for example square, circular, polygonal, nub-shaped, conical, and this also in the form of multidimensional patterns and/or fractals. In particular, the mass element also has a plurality of grid-like structures arranged with a specified distance with respect to one another.

Moreover, the acoustic absorber according to the invention can have means for producing a restoring force acting on the absorption layer. These means serve in particular for allowing the natural frequencies of flexural vibrations of the absorption layer or, if appropriate, of piston-type vibrations of the absorption layer, to be further tuned. By way of example, the means comprise an air-filled volume ("air spring") adjoining the absorption layer. It is conceivable here that the air-filled volume is only formed when the absorption layer is installed in a cavity or as termination of a cavity. For example, the absorber can consist only of the absorption layer and be used as a ceiling plate of a room [illegible] absorption layer is placed for example loosely in a ceiling frame, such that an air-filled volume, into which the absorption plate can move, is present behind the absorption layer, i.e. adjoining a side of the absorption layer which is remote from the room.

According to another variant of the invention, the means comprise an elastic element coupled to the absorption layer. By way of example, the absorption layer is supported by virtue of this elastic element, in particular in a punctiform, linear, or sheet-like manner. The elastic element can, however, also have a mechanical spring of a different configuration.

Moreover, it is also conceivable that the elastic element is formed by an element composed of an open-pore porous material which is connected to the absorption layer (in particular integrally) in the manner of a spring. By way of example, the elastic element is formed by bending off at least one section of the absorption layer, such that the elastic element is connected to the remaining absorption layer via an elastic curvature and extends accordingly at an angle with respect to the remaining absorption layer. The angle between the elastic element and the absorption layer can be chosen depending on use (installation situation, fastening options etc.) of the acoustic absorber, i.e. in the range between 30° and 45°.

It is of course also possible for a plurality of elastic elements to be provided which are connected to the absorption layer for example on opposite sides thereof.

The acoustic absorber according to the invention can additionally have means for damping flexural vibrations and/or piston-type vibrations of the absorption layer. In particular, the damping means can act together with the means for exerting a restoring force on the absorption layer or at the same time be realized thereby. By way of example, an elastic element, which can be used to exert a restoring force on the absorption layer, will also effect a certain damping of vibrations of the absorption layer.

It is, however, also possible for the damping means to comprise separate elements, for example a damping element which is fastened to a spring connected to the absorption layer. In another variant, the damping means comprise an opening, via which air can flow out of an air-filled volume adjoining the absorption layer, wherein the outflow of air via this opening can cause energy from vibrations of the air molecules in the air-filled volume, which were excited by way of vibrations of the absorption layer, to dissipate.

According to another embodiment of the invention, the open-pore porous material of the absorption layer is configured in the form of a densified (and in particular also ductile) nonwoven. A "densified" nonwoven is a non-woven material having an area density that was increased by taking appropriate measures such as needle-punching or compressing. By way of example, for producing the densified nonwoven, a plurality of nonwoven plies composed of flexible organic fibers, for example aramides, or of other organic synthetic fibers, such as polypropylene, viscose, polyacrylonitrile, polyamide or polyester, are used and are needle-punched a number of times on the upper and/or lower side using needles perpendicular to the nonwoven plane or connected in another manner and then densified. The plurality of interconnected nonwoven plies of the absorption layer can consist of the same fiber material or else consist at least partially of different fiber materials.

In particular, the nonwoven material of the absorption layer is densified such that it has a flexural stiffness which corresponds to the flexural stiffness of a layer that is formed of wood or PLEXIGLAS having the same dimensions. PLEXIGLAS is one tradename for poly(methyl methacrylate) (PMMA).

It is additionally possible for the densified nonwoven to be provided for example using mechanical needles with a perforation (for example in the form of a "microperforation", i.e. producing openings having a diameter in the micrometer range), in order to reduce the flow resistance of the densified nonwoven. This perforation is brought about in particular by additional interconnected cavities forming in the densified nonwoven material, with the result that the perforated and densified nonwoven material is of course also an "open-pore porous" material.

Furthermore, a nonwoven can be used that has fibers having a larger diameter than fibers of a conventional absorber material, with the result that even in the case of a high degree of densification of the nonwoven, a flow through the absorption layer or at least a flow into the absorption layer is possible.

The absorption layer which consists of a densified nonwoven can in principle be processed like a conventional rigid material plate, for example by stapling, nailing, screwing, sizing, adhesively bonding, wedging, profiling, patterning, perforating, deforming, coloring and/or transillumination. Methods for producing the densified nonwoven layer will be explained in more detail further below.

According to a development, the open-pore porous material of the absorption layer has first fibers of a first material and second fibers of a second material. By way of example, the first fibers are plastic fibers and the second fibers are bicomponent fibers.

In particular, the first fibers have a higher viscosity (as a measure of the interaction between the fiber molecules, i.e. for the "internal friction" of the fibers) than the second fibers. This can be realized for example by the first fibers being plastic fibers and the second fibers being metal fibers. However, it is also conceivable that the first and the second fibers are produced from different plastics. As a result, a flexurally elastic open-pore porous plate can be produced, which, because the second fibers are less viscous, has a high flexural elasticity and thus immediately reacts to a given sound pressure and begins to vibrate. Owing to the more viscous first fibers, the absorption layer, however, has internal friction, which has a damping effect on the excited vibrations of the absorption layer, with the result that a sound field impinging on the absorption layer loses more energy than when an absorption layer which contains fibers of only one type of viscosity or when a conventional absorber is used.

In particular, the less viscous fibers can absorb more energy (in the form of elastic energy) than the more viscous fibers, whereas, the other way around, the more viscous fibers can convert a greater amount of energy into heat than the less viscous fibers.

The ratio of flexural stiffness of the absorption layer to damping can be set by way of the ratio of the proportion of the viscous fibers to the proportion of the less viscous fibers. Instead of using a higher-viscosity fiber type, or in addition thereto, a different, correspondingly viscous binder can also be used, for example a viscous liquid.

According to another embodiment of the acoustic absorber, the absorption layer has on a side to be facing a sound source a layer for reducing the sound-wave damping by virtue of the open-pore porous material. By way of example, the layer is produced by way of fusing a surface region of the absorption layer ("skin formation"). The reason behind this is in particular to avoid overdamping of higher frequencies, because the air as a carrier medium for the sound waves itself already has a stronger damping action in the case of high frequencies than in the case of lower frequencies. However, it is also possible to apply an additional material onto the surface (e.g. impregnation, adhesive bonding and/or coating) in order to form the coating. The absorption layer can also be produced using a porous, air-permeable, light-weight and/or thin plaster coating. As a result, a visually smooth surface could be produced.

In another variant, the absorption layer has openings other than the pores of the open-pore porous material, which openings in particular have dimensions (e.g. width or diameter) which are greater than the average pore dimensions of the open-pore porous material. However, it is also possible that additional openings ("microperforations") are produced, the dimensions of which are in the same range as the pore dimensions. These additional openings can be used to further increase the sound absorption in a targeted manner in a frequency range. By way of example, at least some of the openings are configured in the form of a slit (e.g. in the form of a microslit).

The openings can here also be in the form of patterns and extend in a plurality of spatial directions, i.e. for example also have sections that extend at an angle to the thickness direction of the absorption layer. By way of example, at least one of the openings extends, when viewed along the thickness direction of the absorption layer, in the manner of single and/or multiple undulation or such that it is rounded, conical, serrated etc. The openings can also be arranged in (e.g. curved or stepped) elevations and/or indentations in a surface of the absorption layer.

At least some of the openings can also be in a form such that they do not pass completely though the absorption layer, but have a depth which is less than the thickness of the absorption layer. The depth of such openings can be considered to be the resonator neck length of a Helmholtz resonator, wherein the remaining thickness of the absorption layer, through which these openings do not extend, represents a flow resistor that is arranged directly at the issuing surface of the resonator necks formed by the openings. Additional damping of these "resonator necks" can thus be dispensed with.

Resonator necks of a Helmholtz resonator can also be formed for example by an edge of the opening projecting over the rest of the surface of the absorption layer. Such a structure can be produced for example by placing an opening in an elevation on the surface.

A Helmholtz resonator can also be produced by way of producing a through-opening in the absorption layer and closing this opening at least on one side with a sound-absorbing layer which is produced from an open-pore porous material for example identically to the absorption layer. By way of example, the absorption layer, in which the resonator opening is provided, is connected via its surface to a further absorption layer, which has similar dimensions as the absorption layer with the resonator opening and extends all the way through in the region of the resonator opening. Moreover, it is also possible to arrange a plurality of such Helmholtz-resonator absorption layers in succession.

Furthermore, the acoustic absorber according to the invention can have means for producing tensile stress in the absorption layer so that the flexural stiffness thereof can be varied. In particular, the means for producing tensile stress comprise a mechanism (e.g. a frame) which is used to clamp the edge (or at least a section of the edge) of the absorption layer and by means of which the absorption layer can be stretched in the manner of a diaphragm in order to change the natural frequencies of the absorption layer.

According to a further embodiment of the invention, the absorption layer formed by the open-pore porous material represents a first absorption layer of the absorber, wherein the absorber has, in addition to the first absorption layer, a second absorption layer which is likewise formed from an open-pore porous material.

Between the first and second absorption layers, a volume can be formed which can be filled for example with air (or any other gas) in order to effect the air cushioning of the absorption layer already mentioned previously. In addition, the volume can be configured between the absorption layers such that vibration energy from the absorption layer can be dissipated by virtue of the volume, i.e. by virtue of the vibrating absorption layer (the "vibration mass") being coupled to the air spring.

In particular, the air-filled volume is configured such that there is a flow connection to the area surrounding the absorber, wherein energy from sound waves, which are excited in the air-filled volume, dissipates because of the outflow and inflow of air into the volume, i.e. it can be converted into thermal energy. By way of example, the air-filled volume is delimited by a frame having at least one opening which provides a flow connection between the air-filled volume and the area surrounding the absorber.

In another variant, arranged in the volume between the first and second absorption layers is an acoustically insulating material, for example an open-pore porous material, which, in particular in addition to an air filling, serves for damping vibrations (flexural and if appropriate piston-type vibrations) of at least one of the absorption layers.

The two absorption layers can differ in terms of their properties, for example can also be formed from different open-pore porous materials. It is also conceivable that the two absorption layers have different dimensions, for example thicknesses.

According to another variant, the first absorption layer has a higher flexural stiffness than the second absorption layer, for example because a different open-pore porous material is used for the first absorption layer and/or the first absorption layer is thicker than the second absorption layer. In particular it is also possible that the first absorption layer has a greater mass per unit area than the second absorption layer.

Of course it is not absolutely necessary for the two absorption layers to differ from each other; it is also possible that two identical absorption layers are provided, or at least two absorption layers which are formed from identical open-pore porous materials. Of course it is also possible for the absorber to have more than two absorption layers, wherein the number and the configuration of the absorption layers can be chosen in dependence on the intended use of the absorber. In particular, a plurality of absorption layers of the absorber can also be connected to one another and be arranged in particular such that their surfaces (which extend perpendicular to the thickness direction of the layers) lie one against another (sandwich structure). By way of example, the absorption layers in a sandwich structure can be connected by way of adhesive bonding, welding, fusing and/or interlocking.

In particular, the absorber has two layers of the same material or of different open-pore and porous materials with a comparatively thinner layer having a comparatively higher densification of the material and having a further comparatively thicker layer having a comparatively lower densification. By way of example, the more densified layer faces a sound source, wherein the more densified layer has for example a significantly higher stiffness than the less densified thicker layer.

Rather than two layers of the same or different open-pore porous materials in one layer of the same material, it is also possible for a whole-area, comparatively thinner region with more densification and/or higher stiffness and a comparatively thicker region with comparatively less densification and/or lower stiffness to be formed. Moreover, the whole-area, thinner region, which is more densified and/or more stiffened, of the material can be produced by way of progressive one-sided densification and stiffening of the material from one side.

Furthermore, the different absorption layers can be connected to one another in a punctiform manner or over an area, preferably by way of adhesive bonding, fusing, holding together using frames or holding structures of firm materials, foaming of plastic, elastic or rigid foamable materials, spraying on or applying liquid or plastically formable materials.

By way of example, the absorption layer comparatively more densified and/or stiffer layer to be facing a sound source is perforated or slit. The change in the thickness of the layer remote from the sound source, i.e. its configuration in varying thickness, in particular influences the range of the absorption action into the low-frequency range, in particular in the manner of a film or plate resonance absorber or diaphragm absorber.

In particular, two or more absorption layers are combined, i.e. placed in rows and connected, wherein, owing to the density of the second, third or each subsequent more densified layer facing the sound source, negative influencing of the absorption action on account of interfering reflections inside the overall structure is avoided. The connection is brought about for example by punctiform or sheet-like adhesive bonding, fusing, holding together using frames or holding structures of firm materials, foaming of plastic, elastic or rigid foamable materials, spraying on or applying liquid or plastically formable materials. Owing to the change in thickness of the less densified and less stiffened layer or of the less densified or stiffened region, the efficiency in the low-frequency range can be set in the manner of a panel, membrane or film resonator. Owing to the open-pore porous property of the thinner, more densified and/or more stiffened layer facing the sound source, however, the sound waves can penetrate this layer such that optimum absorption is achieved even in the higher-frequency range. Surprisingly, the combination of such absorption layers allows for a significantly more broadband absorption action than known absorbers, in particular conventional panel, film or membrane absorbers, but also a high absorption coefficient in the low-frequency range equal to the mode of action of conventional panel, film or membrane absorbers.

Owing to the open-pore porous properties of the in each case more densified and more stiffened layer, any reduction of the increase by virtue of reflections which counteract the absorption action within the absorber structure is avoided. In the case of the joining and/or connection of a mechanical vibration generator to the more densified and/or stiffened layer or frame or holding structures connected thereto, for example the effect that the absorber becomes a broadband air-sound emitter additionally occurs.

Furthermore, the absorber according to the invention can also have at least one sound absorption layer which is not made of an open-pore porous fiber material (but for example of a foam). It is also conceivable that the absorption layer is arranged on an in particular elastic carrier (for example a carrier plate), wherein the carrier is formed in particular from a porous material. By coupling the absorption layer to the carrier, vibrations of the absorption layer matrix vibrations (compression waves and shear waves) inside the carrier, for example inside the skeleton structure of a carrier composed of a porous material, can be excited. Furthermore, depending on the configuration of the carrier, piston-type and/or flexural vibrations in the carrier can also be excited, such that the configuration (e.g. material, dimensions, type of the fastening, type of the bonding) of the carrier can be effected with respect to a tuning optimization of the absorption and/or sound insulation properties of the acoustic absorber according to the invention.

The absorber according to the invention can also have one (or more) further air-permeable layer (e.g. a perforated surface or a grid structure) and/or one (or more) further air-enclosing or air-impermeable layer (e.g. a sheet). The further air-impermeable layer (e.g. composed of steel) can for example be coupled (connected) to the absorption layer in order to produce a layer composite having increased flexural stiffness. The further layers can at least approximately have the surface area dimensions of the absorption layer. However, it is also conceivable for at least some of the further layers (with respect to the surface area) to be smaller than the absorption layer and/or have a different geometry.

According to a further embodiment of the absorber, the absorption layer has a first section which is moveable relative to a second section, with the result that the layer can for example be folded. In particular, the absorption layer can also have more than one (e.g. elongate or punctiform) hinge such that the absorption layer can be expanded and pushed together e.g. in the manner of an accordion with equal or different distances between folds. In particular, the absorption layer can be folded via an elongate hinge (or the multiple hinges) along a line which is parallel to a lateral edge of the absorption layer. A punctiform hinge makes it possible for the absorption layer to fan out in the manner of a pair of scissors.

Folding and/or fanning out the absorption layer makes it possible in particular to set the effective flow resistance of the absorption layer, with the result that the following is true for the flow resistance of the absorption layer in dependence on its thickness d, the mass density $\rho_0$ and the sound speed in air $c_0$ for the flow resistance $\Xi$:

$$\Xi = X \cdot \frac{\rho_0 \cdot c_0 \cdot \sigma}{d} [\mathrm{Pa} \cdot s/m]$$

Here, X is a factor defining the magnitude of the flow resistivity:

$$X = \frac{\Xi \cdot d}{\rho_0 \cdot c_0}$$

When using homogeneous porous absorbers, the magnitude of the flow resistance or the factor X would have to be matched in the production process to the respective thickness. The above variant of the invention allows for the setting of the factor X by way of the fanning out of the absorption layer.

According to a further variant of the invention, the edge of the absorption layer is at least sectionally supported in a frame. In particular, the edge can be fixed in the frame such that the edge region (or at least sections of the edge region) of the absorption layer at least substantially cannot be excited to perform vibrations. The "edge" of the absorption layer delimits the absorption layer in a direction perpendicular to its thickness direction. However the supporting of the absorption layer in a frame is not absolutely necessary, as was already mentioned above.

According to a second aspect, the invention also relates to an acoustic transducer, comprising a moveable layer formed from an open-pore porous material, which layer is moveable for generating sound waves or is moveable by virtue of sound waves, wherein—the open-pore porous material is flexurally stiff in a manner such that flexural vibrations of the moveable layer can be excited and converting means for converting an electric signal into flexural vibrations of the moveable layer and/or for converting flexural vibrations of the moveable layer into an electric signal.

In particular, the moveable layer of the acoustic transducer according to the invention, which layer can be excited to vibrate in the manner of a loudspeaker or microphone diaphragm by way of sound waves, can be configured similarly to the above-described absorption layer, wherein in principle all described configurations of the absorption layer can be transferred to the moveable layer. By way of example, the moveable layer is configured in the form of a densified non-woven material.

According to a development of the acoustic transducer, the converting means comprise a flexural-vibration generator, which is fixed at the moveable layer. By way of example, the flexural-vibration generator is realized by an electric coil which, with one end, is in mechanical contact with a surface of the moveable layer of the transducer, such that coil vibrations can be transferred onto the moveable layer and the moveable layer can be excited to flexurally vibrate or flexural waves can be generated in the moveable layer.

Moreover, the acoustic transducer according to the invention can have means for suppressing reflections of flexural waves excited in the moveable layer at the edge of the moveable layer. These means are to be used to avoid in particular superposition of the flexural waves excited in the moveable layer with reflected waves in order to achieve conversion of sound waves into an electric signal or of an electric signal into sound waves that is as interference-free as possible.

In one variant, the means for suppressing reflections comprise an increase in thickness of the moveable layer toward its edge. It is also conceivable for the means for suppressing to comprise a decrease in mass per unit area of the moveable layer toward its edge.

Furthermore, the means for suppressing reflections can, alternatively or additionally, comprise an increase in porosity and/or viscosity of the moveable layer toward its edge. In addition, the moveable layer can form an outer surface of the acoustic transducer, wherein the means for suppressing reflections comprise an increase in the roughness of the surface toward its edge. It is moreover possible for the means for suppressing to comprise a decrease in flexural stiffness of the moveable layer toward its edge.

According to another embodiment of the transducer according to the invention, the converting means are configured both for converting an electric signal into flexural vibrations of the moveable layer (loudspeaker operation) and for converting flexural vibrations of the moveable layer into an electric signal (microphone operation), wherein the acoustic transducer has switching means, by virtue of which the converting means can be switched from loudspeaker operation into microphone operation. In other words, the acoustic transducer can be operated both as a loudspeaker and as a microphone. This is of course not absolutely necessary, and instead the transducer can also be configured such that it only operates as a loudspeaker, for example.

In one development of this invention variant, the converting means are configured for operating the acoustic transducer at a first time in microphone operation for registering a sound field generated by a sound source and at a second time in loudspeaker operation, and in loudspeaker operation, for producing flexural vibrations of the moveable element in dependence on the electric signal generated during microphone operation such that the acoustic transducer emits sound waves that interfere at least partially with the sound field of the sound source.

According to this, the transducer according to the invention can be used for example for active noise abatement ("anti-sound"), wherein canceling out of the sound waves generated by the sound source that is as extensive as possible is the goal, i.e. sound waves which interfere destructively with the sound field of the sound source are meant to be emitted by the transducer. It is, however, also conceivable that no canceling out of the sound field is meant to be achieved, but generally a change in the sound field, for example in order to match the sound field to acoustic conditions of a room.

By virtue of integration of the electroacoustic transducers (microphone and loudspeaker), it is possible to extend and increase the sound-damping effect of the moveable element. By way of example, the existing vibration forms of the moveable element are electroacoustically amplified.

The invention also relates to a method for producing an acoustic absorber or transducer, in particular as claimed in one of the preceding claims, comprising the following steps:

providing a material layer (in particular in the form of a nonwoven); and densifying and/or foaming the material layer until it is flexurally stiff such that it is excited to flexurally vibrate when sound waves impinge.

In particular, the material layer is used as the "absorption layer" in the above-described acoustic absorber according to the invention. Accordingly, the material layer can be densified or foamed until it has a flexural stiffness of 10 to 100 $Nm^2$, in particular between 10 and 30 $Nm^2$. In another example, the layer is densified or foamed until its lowest natural frequency with respect to flexural vibrations is below 300 Hz.

By way of example, the material layer has, in particular in order to achieve as uniform pore sizes as possible (cavity sizes of the cavities formed between the fibers of the nonwoven), multilayer fiber nonwovens, in particular composed of highly flexible organic fibers, for example organic synthetic fibers such as polypropylene, viscose, polyacrylonitrile, polyamides or polyester.

According to one variant of the method according to the invention, the densification of the material layer formed from a nonwoven is brought about by needle-punching and/or compression. By way of example, the material layer, which as mentioned can consist for example of a plurality of nonwoven plies, is first needle-punched a number of times on the upper and/or lower side using needles perpendicular to the nonwoven plane. It is, however, also possible alternatively or additionally for the nonwoven plies of the material layer to be connected in another way and/or to be pre-rigidified.

Furthermore, in order to bond the nonwoven plies and/or the fibers of the nonwoven plies or to pre-densify (before subsequent compression) the individual plies, a binder, for example in liquid form or in form of latex, and/or a thermally activatable binder, for example in the form of bicomponent fibers, can be used.

For final stiffening, the nonwoven material layer can be compressed to the desired stiffness using a press and in this way densified. After the compression, the material layer can be needle-punched one more time and, after this repeat needle-punching step, compressed one more time. The steps needle-punching/compression of the material layer can of course be repeated as often as is necessary for the desired flexural stiffness and/or air permeability of the material layer. With this method it is possible for example to produce a nonwoven material layer having a flexural stiffness which corresponds to, or exceeds, for example the flexural stiffness of a wood panel (e.g. of birch wood or oak wood), an engineered-wood panel or a PLEXIGLAS panel having comparable (in particular identical) dimensions.

In particular when an already pre-densified material layer is needle-punched, a feed rate, i.e. the speed at which the material layer is transported through a needle-punching apparatus, is selected which is significantly lower than the feed rates used when needle-punching a conventional nonwoven. In particular, a feed rate in the range of 0.50 m/min to 3 m/min, in particular between 0.5 m/min and 2 m/min, is used.

In particular, needle-punching the material layer after compression can serve for producing a perforation (in particular a microperforation) or a partial perforation in the densified material layer, i.e. for increasing the number of interconnected cavities between the fibers of the layer, in order to reduce the flow resistance of the material layer. It is also conceivable that, rather than needle-punching, perforation or partial perforation of the material layer using other mechanical methods (i.e. drilling, perforating by water jet) and/or thermal methods (e.g. hot needle-punching, laser perforation) is used.

Finally, the elasticity of the material layer can also be changed (in particular increased) for example by way of needle-punching and/or calendering. It will be appreciated that materials used as the material layer are in particular nonwovens having a high ultimate strength, with the result that it is possible to excite also flexural vibrations with a high amplitude in the material layer, without damaging the material layer. By way of example, nonwovens whose fibers have a suitable length (e.g. at least 40 mm) and which are sufficiently elastic and nonbreakable are used.

As already mentioned above in connection with the absorption layer, the material layer can in particular have different types of fibers and/or nonwoven layers made of different types of fibers. By way of example, it is possible to add to a starting material of a first fiber type fibers of a second fiber type (e.g. with a viscosity that is different from the first fiber type).

Moreover, it is also conceivable that additionally (or instead of fiber types with differing viscosity) another viscous material is added, which has a higher viscosity than the fibers of the nonwoven material layer, in particular in order to influence the restoring elasticity of the material layer under flexural stress. By way of example, in this way higher energy absorption and damping of vibrations of the material layer can be achieved, i.e. the restoring takes place in the case of a flexurally elastic stress on the material layer with increased inertia, such that more energy is taken from the vibrations of the material layer and thus from a sound field acting on the material layer.

It is also possible for the densified material layer to be thermoformed in order to bring about a form that is desired for an acoustic absorber. The fibers of a nonwoven used for producing the material layer can also have a coating or be provided with a coating within the process of producing the material layer. By way of example, this may be a dirt-repellent coating of the fibers and/or a coating to impart color, for flame retardation, suppressing smells, increasing hydrolysis resistance, UV protection, dirt repellence, water repellence of the fibers, with for example a plasmapolymer functional coating, a Teflon coating and/or a nanocoating being possible.

It will be appreciated moreover that waste of the used nonwoven materials that occurs during production of the material layer can be recycled and used in turn as a starting material for producing a further material layer. To this end, the wastes are for example shredded and subsequently processed according to the above-described method for producing the material layer.

By way of example, the absorption layer has openpore foams, fiber materials, mineral substances, glass materials, ceramics, plastics, but also solid materials like porous concrete or the like. The term "glass" includes glass itself and also any glass-related materials such as PLEXIGLAS, acrylic glass, organic glass, such as crystal glass.

A "plastic" is for example PVC, polyethylene, polypropylene, polyester, polystyrene including polystyrene with glass fiber, rubber, including natural rubber, in particular foams of plastics and also plastics films composed of the previously mentioned materials. The absorption layer, however, can also have metal such as aluminum, lead, copper, brass, iron, steel including the refined forms such as stainless steel and also steel alloys and cast steel, malleable iron, sintered metals such as zinc, tin, gold and platinum.

It is of course also possible to produce the absorption layer from paper including paper fibers. But also construction materials such as concrete including lean concrete, porous concrete, lightweight concrete, aerated concrete, reinforced concrete, and also cement including cement flooring or natural woods such as spruce, beach, chestnut, oaks, larch, acorn, ebony, but also engineered forms of natural wood such as chipboards, wood wool, fibreboards and plywood can be used in accordance with the invention. The same is true for bitumen and bitumen-like construction materials, gypsum including plasterboards, clays and loams, coconut including coconut fibers and also mats, cork including natural cork, expanded granulated cork, granulated cork also as mats, fiber wool including mineral wool, felt, wool, basalt wool, animal wool or hair, rock wool, leather, animal leather and synthetic leather, soft fiber products composed of natural and synthetic materials, synthetic and natural epoxies including epoxy with glass fibers and also hemp including in the form of mats.

Furthermore, the following substances can be used as layer material:

- magmatic rocks
- plutonites (plutonic rock): for example granite, gabbro, syenite, diorite, granodiorite)
- vulcanites (igneous rock): for example basalt, phonolite, porphyry, obsidian, lava, pumice)
- clastic (mechanical) sediment rock: for example sandstone, conglomerate, breccias, shale, tuff, molasse
- chemical sediment rock: for example limestone, coquina, dolomite, chalk, mineral salt, potash salt, gypsum
- biological (biogenic) sediment rock: for example peat, lignite, coal
- metamorphic rock
- para-rock (from sediment) & ortho-rock (from magmatites): for example marble, slate, green slate, Fruchtschiefer, quartzite, sericite gneiss, phyllite, mica schist, gneiss mica schist, granulite, gneiss.

All these materials mentioned can be used preferably in perforated, microperforated, porously sintered or expanded form for producing the open-pore porous layers.

Furthermore it is possible to use these materials in splintered or comminuted and subsequently re-assembled, for example compressed, form for producing an open-pore porous structure as a circular capillary, gap capillary or microcapillary skeleton structure, in particular by way of adhesive bonding or partial fusion.

In a further preferred embodiment of the invention, the abovementioned materials are coated with liquid materials, such as dye which is used to produce open-pore porous structures using a spray method. The pot times in the case of pigmented application or application using admixtures of dissolving binders or binders that form air spaces must be adjusted.

BRIEF DESCRIPTION OF THE DRAWINGS

The invention will be explained in further detail below with reference to exemplary embodiments using the figures in which:

FIGS. 2A to 2D show further variants of the acoustic absorber according to the invention;

FIGS. 3A and 3B show further exemplary embodiments of the acoustic absorber according to the invention;

FIGS. 6A to 6C show acoustic absorbers according to further exemplary embodiments of the invention;

DETAILED DESCRIPTION

FIGS. 1A to 1D show in each case a panel-type absorption layer 1 of the acoustic absorber according to the invention, wherein the absorption layers have in each case a continuously varying mass density. According to the example of FIG. 1A, the mass density of the open-pore porous material continuously increases in the thickness direction of the absorption layer 1, i.e. the mass density becomes continuously smaller from a first side 11 (which is to face for example a sound source) in the direction of a second side 12 of the absorption layer 1, which is opposite the first side.

Figure 1A:
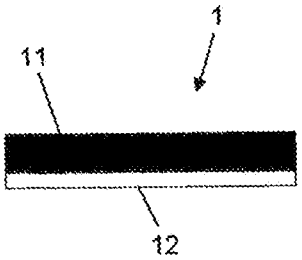
FIGS. 1A to 1G show different variants of the acoustic absorber according to the invention.
Figure 1B:
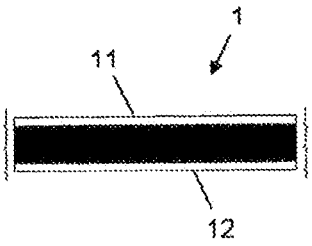
Figure 1C:
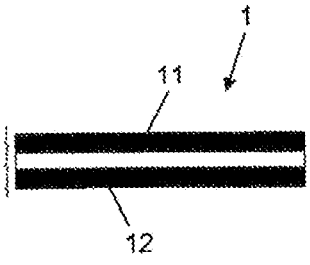
Figure 1D:
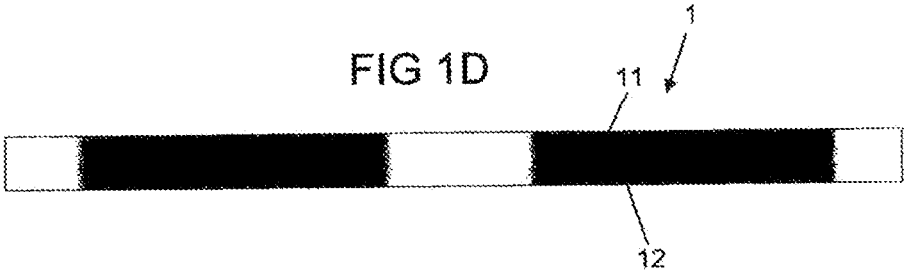

In the example of FIG. 1B, the mass density of the absorption layer continuously increases toward the center (viewed in the thickness direction), whereas in FIG. 1C, the mass density continuously decreases toward the center of the layer. According to the exemplary embodiment of FIG. 1D, the mass density varies periodically in a direction that is transverse with respect to the thickness direction of the absorption layer, i.e. along a direction which is parallel to the main extension plane of the absorption layer.

Figure 1E:
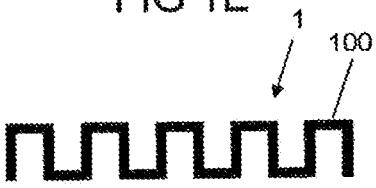
Figure 1F:
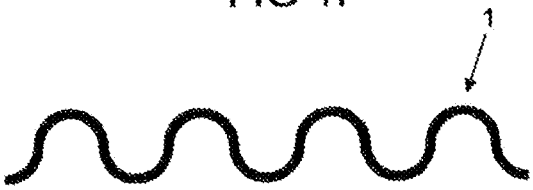
Figure 1G:
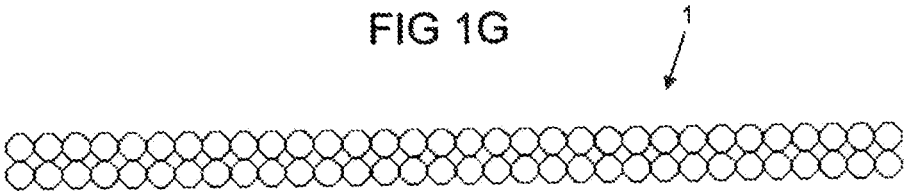

Other possible configurations of the absorption layer 1 are shown in FIGS. 1E to G. FIG. 1E shows an absorption layer which is not planar but has, at least sectionally, a ribbed structure 100. In the example of FIG. 1F, the absorption layer has an undulating configuration. It is furthermore conceivable that the absorption layer 1 has at least sectionally a honeycomb structure, in particular in order to increase its stability.

Furthermore, it is also possible that the absorption layer 1 has a base body 13 (rectangular in cross section, for example), from which structures 131 which are rectangular in cross section (FIGS. 2A and B) (and are arranged for example periodically) project. According to the FIGS. 2C and D, a plurality of structures 132 having a curved surface project above the base body. As a result, at least one side of the absorption layer has a rib structure as in FIGS. 2A and B or an undulating structure as in FIGS. 2C and D.

The variants of FIGS. 1A to 1G and 2A to D can of course also be combined with one another.

FIGS. 3A and B relate to a further embodiment of the absorber according to the invention, wherein FIG. 3A shows the absorber in a view from above and FIG. 3B shows the absorber in a perspective view. Accordingly, an absorption layer 1 is supported in a carrier frame 2. In particular, the absorption layer can be supported in the frame in a manner such that an air volume is present on a rear side of the absorption layer which is to face away from a sound source, which air volume acts as a spring coupled to the absorption layer.

Figure 4A:
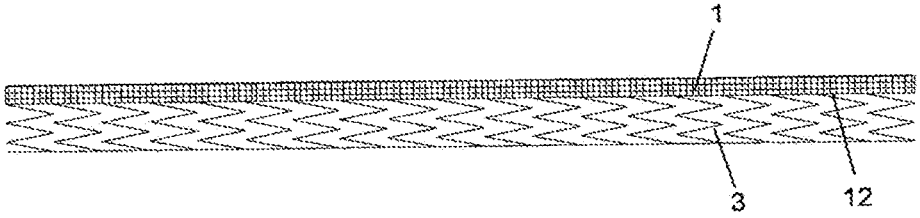
FIGS. 4A and 4B show different possibilities for supporting the absorption layer of the acoustic absorber according to the invention.
Figure 4B:
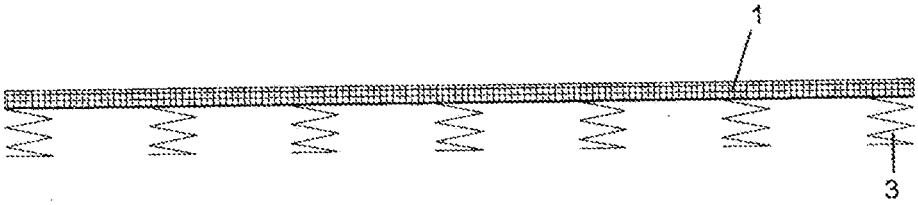

Instead of or in addition to a rearward air cushion, it is however also possible for other elastic elements to be coupled to the absorption layer of the absorber. This is shown in FIGS. 4A and 4B. According to FIG. 4A, a plurality of spring elements 3 are arranged on a rear side 12 of the absorption layer, wherein the spring elements are positioned in close proximity with one another such that it leads to sheet-like supporting of the absorption layer. Instead of a plurality of individual spring elements which are arranged in close proximity with one another, it is also possible to use an elastic element with a large surface area, which is coupled to the absorption layer for example approximately over the entire surface of the rear side thereof.

Another possibility for spring-like support of the absorption layer 1 is shown in FIG. 4B. According to this figure, a plurality of spring elements 3 are arranged such that they are mutually spaced apart, wherein in each case one side of the spring elements is coupled to the rear side of the absorption layer 1. By virtue of this arrangement of the spring elements 3, in particular punctiform support of the absorption layer 1 can be achieved.

According to variants 5A to D, a mass element 4 is placed on the actual absorption layer 1, which mass element 4 is in particular made of a different material than the absorption layer. The mass element serves in particular for tuning the natural frequencies of the absorption layer 1.

Figure 5A:
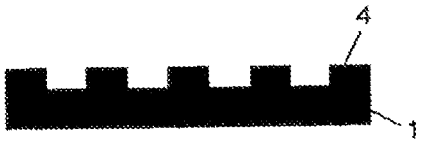
FIGS. 5A to 5D show further embodiments of the acoustic absorber according to the invention.
Figure 5B:
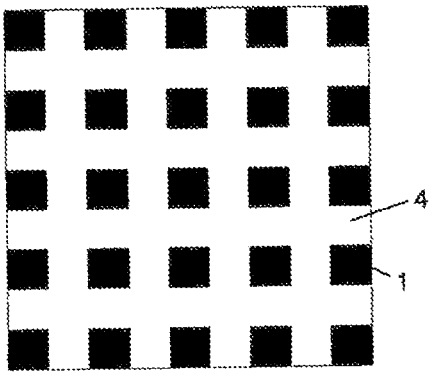
Figure 5C:
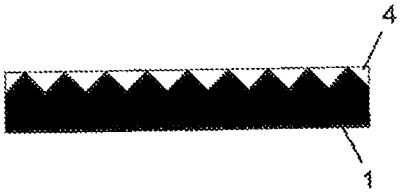
Figure 5D:
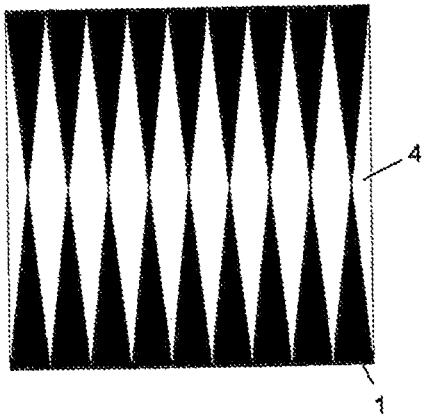

The mass element can have in principle any arbitrary geometry, for example in the manner of a grid (according to the sectional view in FIG. 5A or the plan view in FIG. 5B) or of rhomboids (FIGS. 5C and D). According to FIG. 5C, the mass element 4 is arranged at least partially in depressions in the surface of the absorption layer 1.

FIGS. 6A to C relate to further embodiment variants of the absorber according to the invention. Accordingly, an absorption layer 1 of the absorber is supported on a frame 2 such that there is an air volume 5 between a base section 21 of the frame 2 and a rear side 12 of the absorption layer 1, which air volume 5 acts in the manner of an elastic element and, together with the absorption layer 1, forms a mass-spring system which can be excited to vibrate by way of sound waves acting on a front side 11 of the absorption layer 1. The frame has, in addition to the base plate 21, side walls 22 which project perpendicularly from the base plate 21 and enclose a side edge 14 of the absorption layer.

The absorber according to the invention can also have other means for generating a restoring force on the absorption layer, in particular the side walls of the frame can be of elastic configuration. It is also possible that the absorption layer 1 is coupled to elastic elements for example in the form of a spring 3 or an elastic wall 31, which absorb a vibration of the absorption layer. In particular, the elastic elements are coupled, in the region of their side edge 14, with the absorption layer, for example two elastic elements are provided which are coupled to the absorption layer on opposite side-edge sections thereof; cf. FIGS. 6B and C.

Figure 7:
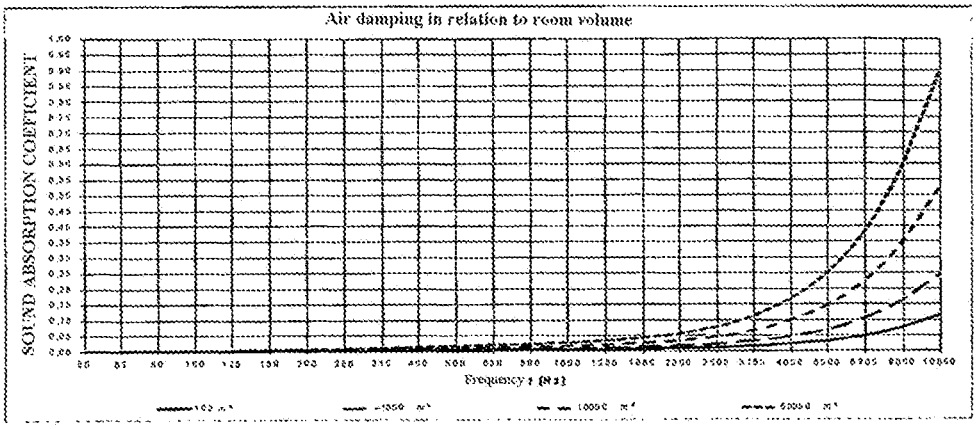
FIG. 7 shows a graph relating to the sound absorption behavior of air.
Figure 9:
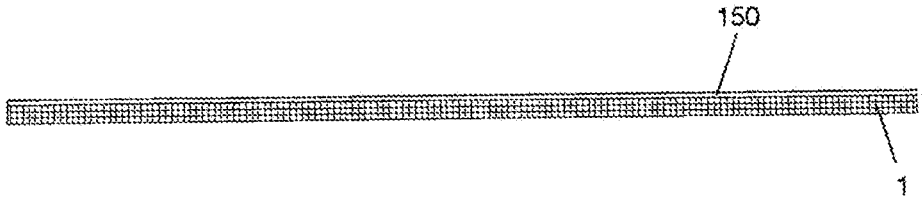
FIG. 9 shows a further embodiment of the acoustic absorber according to the invention.

FIG. 7 illustrates the sound absorption behavior of air with respect to different air volumes. According to this figure, air has, in particular at higher frequencies (ca. from 2000 Hz onwards) a higher sound absorption that at lower frequencies. In order to avoid overdamping in this higher frequency range, the absorption layer of the absorber according to the invention can on its side to be facing the sound source have a coating 150, for example in the form of a "skin formation", which can be produced by fusing a surface region of the absorption layer; cf. FIG. 9.

Figure 8:
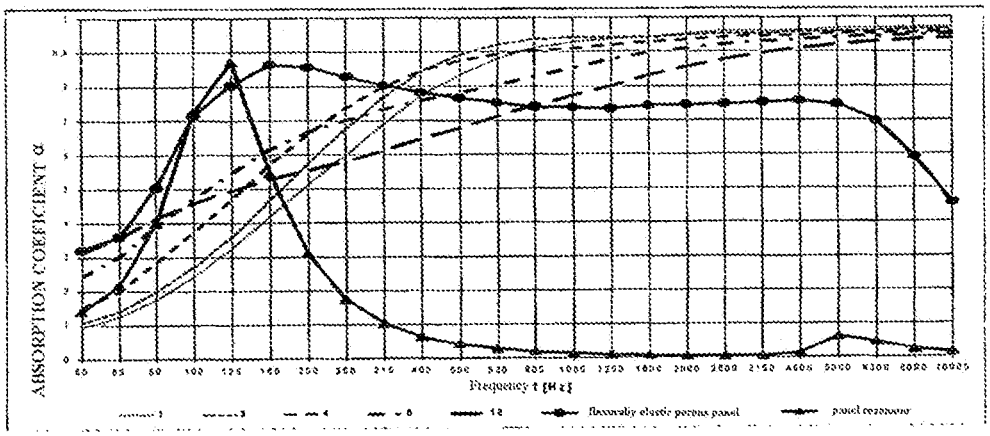
FIG. 8 shows a graph relating to the absorption behavior of different open-pore porous materials.

FIG. 8 shows the absorption behavior of different conventional open-pore porous absorbers compared to the flexurally elastic absorption layer (dots) of the absorber according to the invention. While the conventional absorbers absorb significantly less in the lower frequency range (below ca. 600 Hz) than in the higher frequency range (above 600 Hz), the flexurally elastic absorption layer also absorbs in the range below 600 Hz because of the excited flexural vibrations.

For further comparison, the graph also shows the absorption behavior of a panel resonator (triangles), which absorbs nearly exclusively because of excited flexural vibrations, i.e. nearly exclusively in the low-frequency sound range, while the absorption layer of the absorber according to the invention absorbs both in the low-frequency and in the higher-frequency ranges.

Figure 10A:
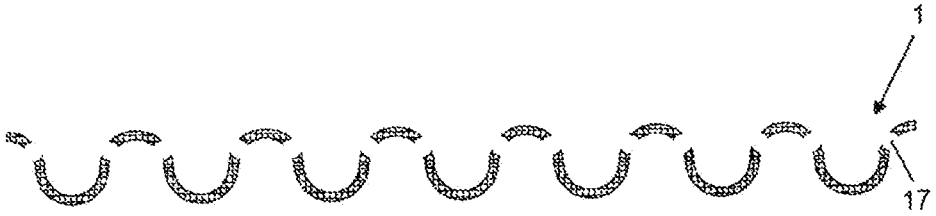
FIGS. 10A to 10D show variants of an acoustic absorber according to the invention having a perforated absorption layer.
Figure 10B:
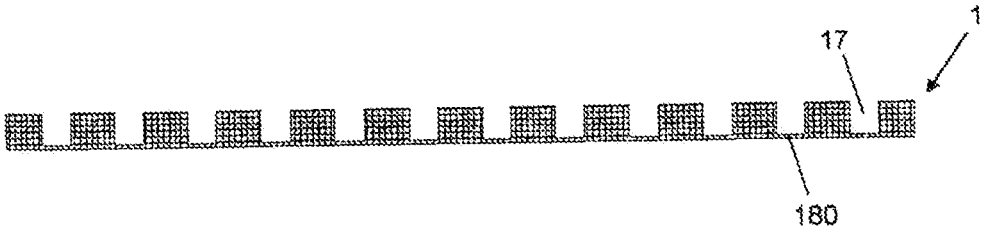
Figure 10C:
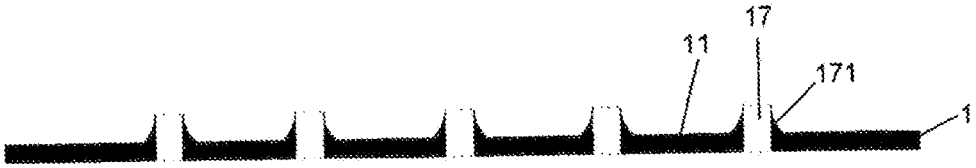
Figure 10D:
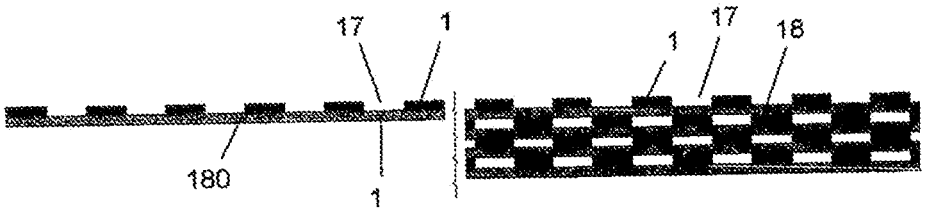

In order to further adjust the absorption behavior of the absorption layer, it can have a perforation; cf. FIGS. 10A to D. By way of example, the absorption layer 1 is of undulating configuration and has at the side flanks of the "wave" openings 17 (FIG. 10A). It is also possible for the absorption layer to have no through-openings (FIG. 10B) but openings which are covered on one side of the absorption layer (in particular using an insulating material 180) such that, in a way, a great number of Helmholtz resonators are created. A plurality of such absorption layers can also be arranged one on top of the other (FIG. 10D). In another example, the openings 17 are formed in elevations 171 on a surface 11 of the absorption layer (FIG. 10C).

Figure 11:
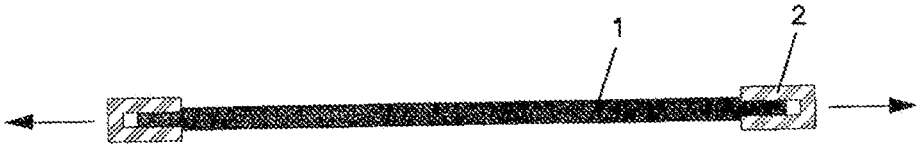
FIG. 11 shows a further embodiment of the acoustic absorber according to the invention.

According to the exemplary embodiment of FIG. 11, the absorption layer 1 is supported in a frame 2 such that it can be stretched across the frame transversely to its thickness direction in order to tune the natural frequencies of the absorption layer.

Figure 12A:
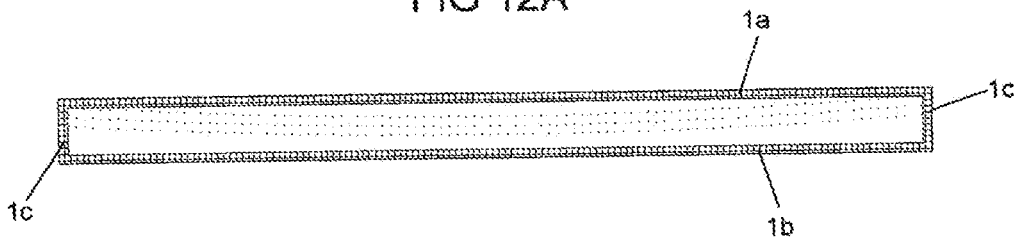
FIGS. 12A to 12E show further exemplary embodiments of the acoustic absorber according to the invention.
Figure 12B:
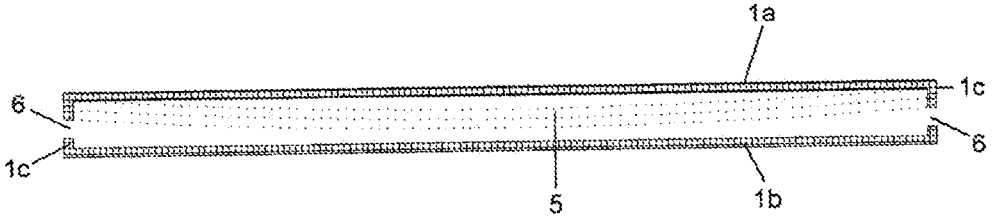

The exemplary embodiments of FIGS. 12A to E relate to a variant of the absorber according to the invention, according to which two absorption layers 1*a*, 1*b* are provided. According to FIG. 12A, both absorption layers 1*a*, 1*b* are arranged at a distance and parallel with respect to each other and connected to each other integrally in particular via a side edge 1*c*. Openings 6 can additionally be provided in the side edge 1*c*, via which openings the air can flow out of a volume 5 which extends between the absorption layers 1*a*, 1*b* (FIG. 12B).

Figure 12C:
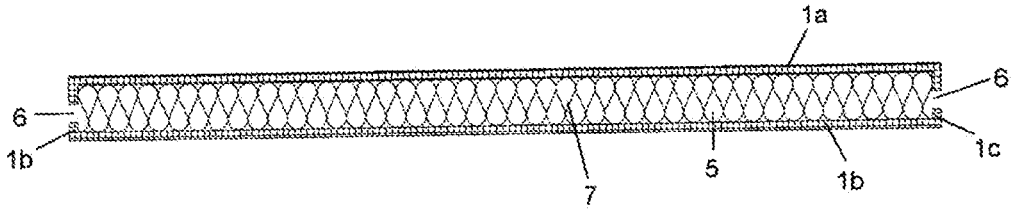
Figure 12D:
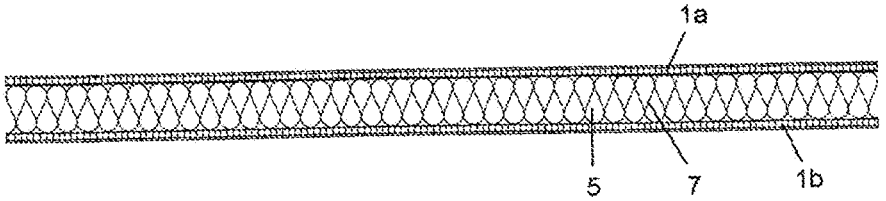
Figure 12E:
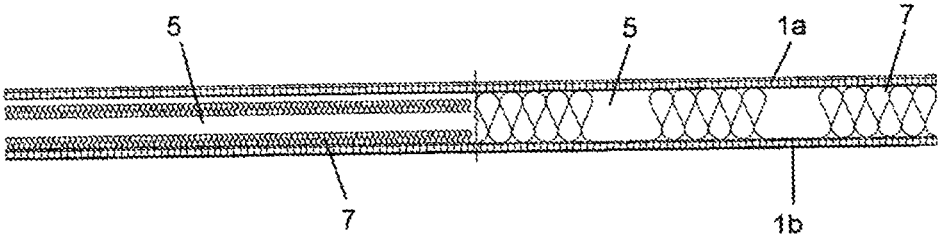

Moreover, an insulating material 7 can be arranged in the volume 5, in particular in a manner such that the volume is at least approximately completely filled (FIG. 12C). The absorption layers 1*a* and 1*b* of course do not have to be integral with one another, but can also be formed in each case without a side edge such that they are planar (FIG. 12D), wherein the volume 5 can be filled with an insulating material 7 (as in FIG. 12C). The insulating material is in particular configured such that it fills the volume 5 only partially (FIG. 12E).

Figure 13A:
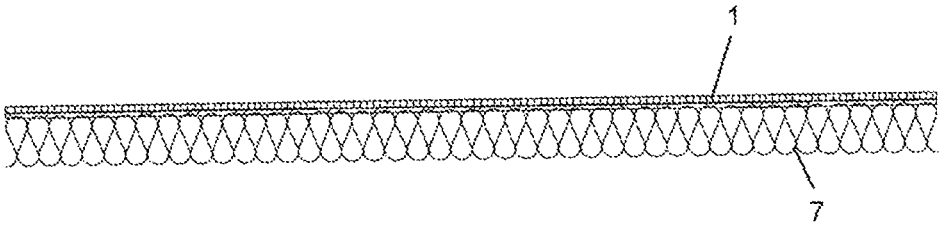
FIGS. 13A to 13C show variants of the absorption layer of the acoustic absorber according to the invention.
Figure 13B:
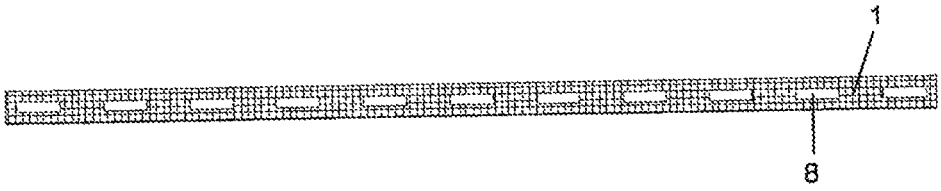
Figure 13C:
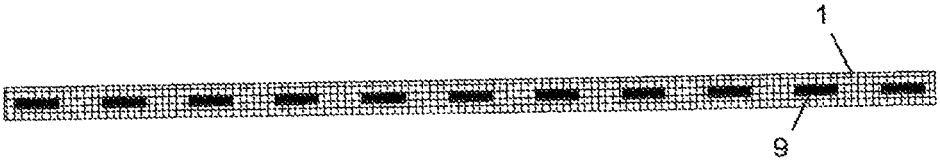

Even if the absorber according to the invention has only one absorption layer, the latter can on its rear side have an insulating material (FIG. 13A). It is moreover possible for the absorption layer to have air inclusions 8 (FIG. 13B) or another material 9 (e.g. composed of metal) which is for example formed in the manner of a grid, in order to increase its flexural stiffness (FIG. 13C).

Figure 14:
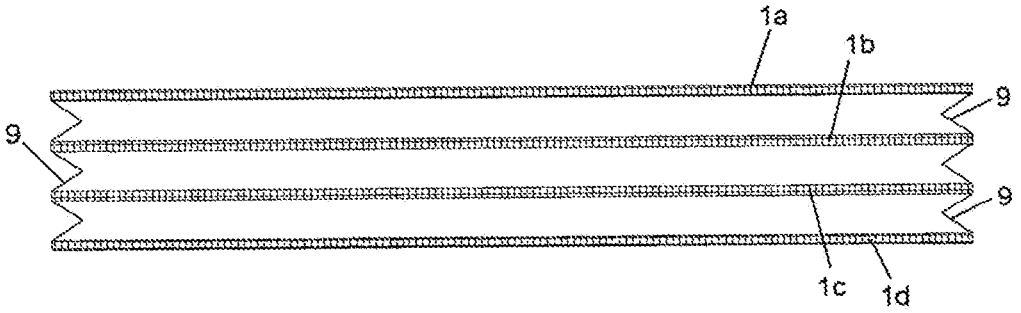
FIG. 14 shows a further exemplary embodiment of the acoustic absorber according to the invention.

FIG. 14 shows a further embodiment of the absorber according to the invention. According to this figure, a plurality of absorption layers 1*a*-1*d* are arranged at a distance and parallel with respect to one another. The absorption layers 1*a*-1*d* are connected to one another via hinge elements 9 such that the distance between the absorption layers can be changed in the manner of an accordion. The hinge elements can be formed in particular by flexible material pieces (e.g. from a textile material).

Figure 15:
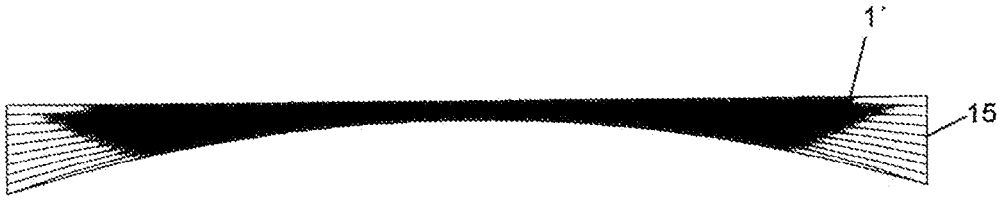
FIG. 15 shows a moveable element of the acoustic transducer according to the invention.

FIG. 15 relates to an embodiment of the moveable element 1' of the acoustic transducer according to the invention. The thickness of the moveable element 1' increases from its center to the side edge 15 (i.e. along the main extension planes of the moveable element). This serves in particular for suppressing reflections of flexural waves which are excited in the moveable element at the side edge.

It will be appreciated that elements of the exemplary embodiments explained above can of course also be combined with one another. By way of example, the moveable element of FIG. 15 can have elements of the absorption layers of FIGS. 1 to 14 (for example an additional mass element or a perforation).

The invention claimed is:

1. An acoustic absorber, comprising an absorption layer formed from an open-pore porous material, wherein the open-pore porous material is formed flexurally elastically in such a way that flexural vibrations are excited in the absorption layer when sound waves strike it and, owing to the inflow of air into the open-pore porous material of the absorption layer, the absorber can absorb sound waves in a first frequency range and, on account of the excitation of flexural vibrations of the absorption layer, sound waves in a second frequency range, which comprises lower frequencies than the first frequency range, and wherein the open-pore porous material is a nonwoven material densified to have a flexural stiffness which corresponds to or exceeds flexural stiffness of a layer that is formed of poly(methyl methacrylate) (PMMA) having identical dimensions as the open-pore porous material of the absorption layer.

2. The acoustic absorber as claimed in claim 1, wherein the open-pore porous material is viscous such that flexural vibrations of the absorption layer are damped.

3. The acoustic absorber as claimed in claim 1, wherein the absorption layer has a flexural stiffness in the range of 200 to 400 Nm.

4. The acoustic absorber as claimed in claim 1, wherein the lowest flexural-vibration natural frequency of the absorption layer is in the range between 0.00005 Hz and 300 Hz.

5. The acoustic absorber as claimed in claim 1, wherein the mass per unit area varies in the thickness direction of the absorption layer and/or in a direction that is perpendicular to the thickness direction.

6. The acoustic absorber as claimed in claim 1, wherein the absorption layer is supported such that piston-type vibrations can be excited therein.

7. The acoustic absorber as claimed in claim 1, wherein the open-pore porous material has first fibers of a first material and second fibers of a second material.

8. The acoustic absorber as claimed in claim 7, wherein the first fibers have a higher viscosity than the second fibers.

9. The acoustic absorber as claimed in claim 1, wherein the absorption layer formed by the open-pore porous material represents a first absorption layer of the absorber and the absorber has a second absorption layer which is likewise formed from an open-pore porous material.

10. The acoustic absorber as claimed in claim 1, wherein the edge of the absorption layer is at least sectionally supported in a frame.

11. The acoustic absorber as claimed in claim 1, wherein the acoustic absorber is exclusively formed by a plate-like absorption layer.

12. The acoustic absorber as claimed in claim 1, wherein the absorption layer is inserted loosely in a frame, or the absorption layer is at least partially clamped in a frame or the absorption layer is supported in such a manner that it can vibrate freely.

13. The acoustic absorber as claimed in claim 1, wherein the nonwoven material comprises at least one nonwoven layer and a binder in the form of latex and/or a thermally activatable binder that bonds the nonwoven layers and/or the fibers of the nonwoven layer.

* * * * *